US009239152B2

(12) United States Patent
Ho

(10) Patent No.: US 9,239,152 B2
(45) Date of Patent: Jan. 19, 2016

(54) LED HOLDER

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/478,304

(22) Filed: Sep. 5, 2014

(65) Prior Publication Data

US 2015/0131301 A1 May 14, 2015

(30) Foreign Application Priority Data

Sep. 5, 2013 (TW) ..... 102216709 U

(51) Int. Cl.

| | |
|---|---|
| ***F21V 19/00*** | (2006.01) |
| *F21Y 101/02* | (2006.01) |
| *F21V 23/06* | (2006.01) |
| *F21Y 105/00* | (2006.01) |

(52) U.S. Cl.

CPC ..... *F21V 19/0055* (2013.01); *F21V 19/004* (2013.01); *F21V 23/06* (2013.01); *F21Y 2101/02* (2013.01); *F21Y 2105/00* (2013.01); *F21Y 2105/001* (2013.01)

(58) Field of Classification Search

CPC .... F21V 19/004; F21V 19/0055; F21V 23/06
See application file for complete search history.

(56) References Cited

U.S. PATENT DOCUMENTS

| | | | | |
|---|---|---|---|---|
| 4,133,595 | A * | 1/1979 | Pritulsky | 439/441 |
| 7,204,711 | B2 * | 4/2007 | Garcia et al. | 439/336 |
| 7,540,761 | B2 * | 6/2009 | Weber et al. | 439/487 |
| 7,611,376 | B2 * | 11/2009 | Daily et al. | 439/419 |
| 7,828,557 | B2 * | 11/2010 | Vogt et al. | 439/56 |
| 8,246,204 | B2 * | 8/2012 | McCanless | 362/249.02 |
| 8,308,501 | B2 * | 11/2012 | Mostoller et al. | 439/457 |
| 8,684,568 | B2 * | 4/2014 | Nagaoka et al. | 362/374 |
| 8,834,194 | B2 * | 9/2014 | Sakai | 439/345 |
| 8,926,135 | B2 * | 1/2015 | Zaderej et al. | 362/249.05 |
| 2008/0285271 | A1 * | 11/2008 | Roberge et al. | 362/235 |
| 2010/0302778 | A1 * | 12/2010 | Dabiet et al. | 362/249.02 |
| 2012/0156920 | A1 * | 6/2012 | Sakai et al. | 439/387 |
| 2013/0077326 | A1 * | 3/2013 | Zantout et al. | 362/396 |
| 2013/0084748 | A1 * | 4/2013 | Zaderej et al. | 439/620.02 |
| 2013/0176708 | A1 * | 7/2013 | Mostoller | 362/95 |
| 2013/0176732 | A1 * | 7/2013 | McGowan et al. | 362/249.02 |
| 2013/0271983 | A1 * | 10/2013 | Leshniak et al. | 362/235 |
| 2014/0063814 | A1 * | 3/2014 | McGowan et al. | 362/308 |
| 2014/0104846 | A1 * | 4/2014 | Wronski | 362/294 |
| 2014/0153260 | A1 * | 6/2014 | Wronski | 362/373 |
| 2014/0268887 | A1 * | 9/2014 | Schroll et al. | 362/652 |
| 2015/0055356 | A1 * | 2/2015 | Derks et al. | 362/418 |
| 2015/0070887 | A1 * | 3/2015 | Yamauchi | 362/231 |

(Continued)

*Primary Examiner* — Ross Gushi
(74) *Attorney, Agent, or Firm* — Stephen L. Sheldon

(57) ABSTRACT

A holder comprises a base body, at least two terminals, a connector and at least two wires. The base body defines a receiving hole for receiving the light emitting module. The terminals are provided to the base body and each have a pressing contact portion and a wire insertion structure, the pressing contact portions extend into the receiving hole and respectively press against the contact pads of the light emitting module. The connector is provided to the base body so as to externally connect a mating connector. The wires respectively correspond to the terminals to allow one end of each wire to be detachably connected to the wire insertion structure of the corresponding terminal and the other end of the each wire to be connected to the connector so that the terminals and the connector are electrically connected.

13 Claims, 8 Drawing Sheets

(56) References Cited

U.S. PATENT DOCUMENTS

2015/0109801 A1* 4/2015 McGowan et al. ..... 362/370
2015/0117033 A1* 4/2015 Chiu et al. ..... 362/363
2015/0131299 A1* 5/2015 Meyer et al. ..... 362/373
2015/0131301 A1* 5/2015 Ho ..... 362/382

* cited by examiner

LED HOLDER

RELATED APPLICATIONS

This application claims priority to Taiwanese Application No. 102216709, filed Sep. 5, 2014, which is incorporated herein by reference in its entirety.

FIELD OF THE PRESENT DISCLOSURE

The present disclosure relates to a holder for mounting a light emitting module, and particularly relates to a holder for an illumination device and an illumination device.

BACKGROUND OF THE PRESENT APPLICATION

Recently, a light emitting diode (LED) has been widely applied in many fields due to its advantages of energy saving, environmental protection, long service life and the like, especially many types of products in the illumination field have been developed. One type of product is an illumination device formed by a LED module, for example, Taiwanese patent No. TWM409543 (corresponding to US2013/0084748A1, W02011/088212A2, CN201120042217.0 and CN201180004948.9) discloses a holder assembly for fixing a LED module. The LED module is formed by packaging a plurality of dies arranged in array, the holder assembly disclosed in the previous patent is used to fix the LED module so as to conveniently connect a power.

An electrical connection mechanism of the holder assembly in the previous patent is generally classified as two manners. One manner is to allow a positive electrode wire and a negative electrode wire to be respectively inserted into two terminals of the holder assembly which are respectively electrically connected to the LED module; the other manner is to allow traces provided on a frame to connect two terminals which are respectively electrically connected to the LED module and then allow another connector to connect the traces, so as to conveniently perform assembly. The two manners have their own advantages and disadvantages. The former is relative complicate in assembly operation since the wires are required for separate insertion; the latter is relatively convenient to assemble, but manufacturing of the frame is relative complicate and the cost is relatively high since the traces are required to arrange on the frame.

SUMMARY OF THE INVENTION

Accordingly, an illumination device comprises a light emitting module and a holder. The light emitting module has a light emitting portion and at least two contact pads. The holder comprises a base body, at least two terminals, a connector and at least two wires. The base body defines a receiving hole for receiving the light emitting module. The two terminals are provided to the base body and each have a pressing contact portion and a wire insertion structure, the pressing contact portions extend into the receiving hole and respectively press against the contact pads of the light emitting module. The connector is provided to the base body so as to externally connect a mating connector. The wires respectively correspond to the terminals to allow one end of each wire to be detachably connected to the wire insertion structure of the corresponding terminal and the other end of the each wire to be connected to the connector so that the terminals and the connector are electrically connected.

In an embodiment of the illumination device, the base body has a mounting groove for receiving the connector. In an embodiment of the illumination device, the wire insertion structures of the terminals are in form of wire trap. In an embodiment of the illumination device, the wire insertion structures of the terminals are in form of two-way wire trap. In an embodiment of the illumination device, the wire insertion structures of the terminals are in form of insulation-displacement termination. In an embodiment of the illumination device, the illumination device further comprises: a cover covering the holder and assembled to and engaged with the holder, and having an opening for exposing the light emitting portion and an aperture which allows the connector to expose outwardly.

In an embodiment of the illumination device, the base body further has a top face and a bottom face, and the receiving hole has a window portion passing through the top face and a frame groove portion recessed from the bottom face toward the top face, and the window portion and the frame groove portion are communicated, the light emitting module is received in the frame groove portion and the light emitting portion is exposed from the window portion; the base body further has at least a resilient abutting block defining a part of the frame groove portion to abut against a side edge of the light emitting module.

The effects of the present disclosure are as follows: the holder has the connector to mate with the mating connector so as to allow convenient assembly, and the connector and the terminal are connected via the wire, which may omit arrangement of traces so as to simplify the manufacturing process and save the cost. Moreover, one end of the wire is detachably connected to the terminal, if the connector is not required then the wire is removed together with the connector so as to provide the desired mounting features, thus the holder has improved flexibility.

BRIEF DESCRIPTION OF THE DRAWINGS

The other features and effects of the present disclosure will be apparent through embodiments with reference to the Figures, and in which.

DETAILED DESCRIPTION OF THE PREFERRED EMBODIMENTS

Figure 1:
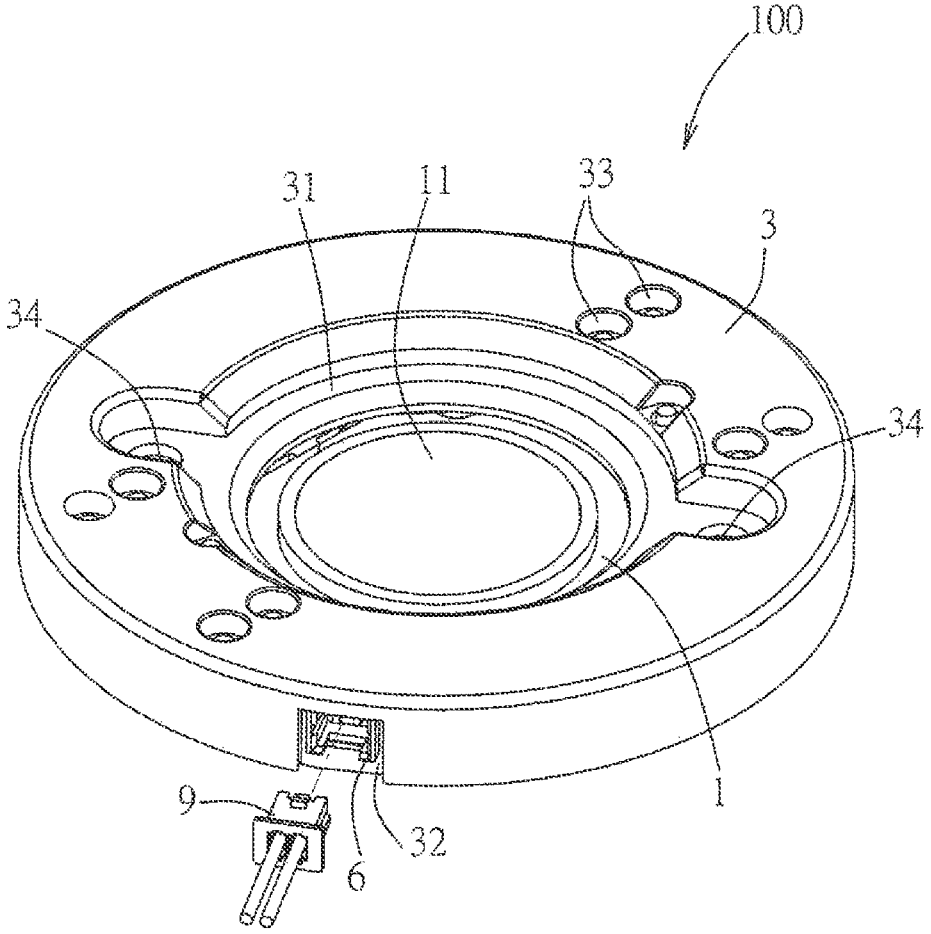
FIG. 1 is a perspective view illustrating a connection relationship between a first embodiment of an illumination device of the present disclosure and a mating connector.

Before the present disclosure is described in detail, it should be noted that similar elements are indicated by the same reference numeral in the following description. Benefits of the present disclosure include providing a holder which is conveniently assembled and easily manufactured. Another benefit is to provide a dual-function holder that can optionally provide a connector. Another benefit is to provide an illumination device having the previous holder.

Figure 2:
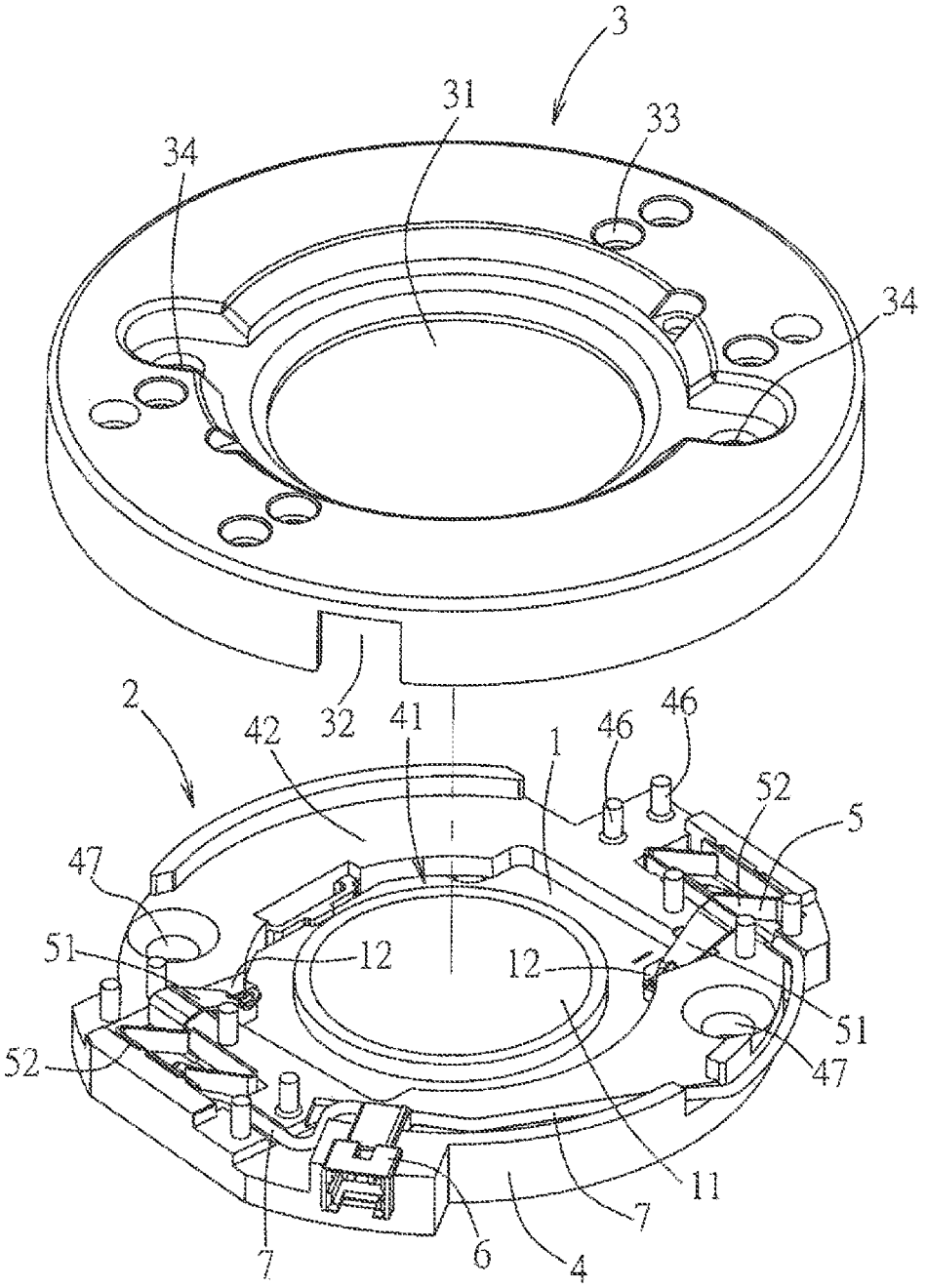
FIG. 2 is an exploded perspective view illustrating an assembly relationship between a cover and a holder of the first embodiment.

Referring to FIG. 1 and FIG. 2, a first embodiment of an illumination device 100 of the present disclosure may be use for externally connecting a mating connector 9, the illumination device 100 comprises a light emitting module 1, a holder 2 and a cover 3.

Figure 3:
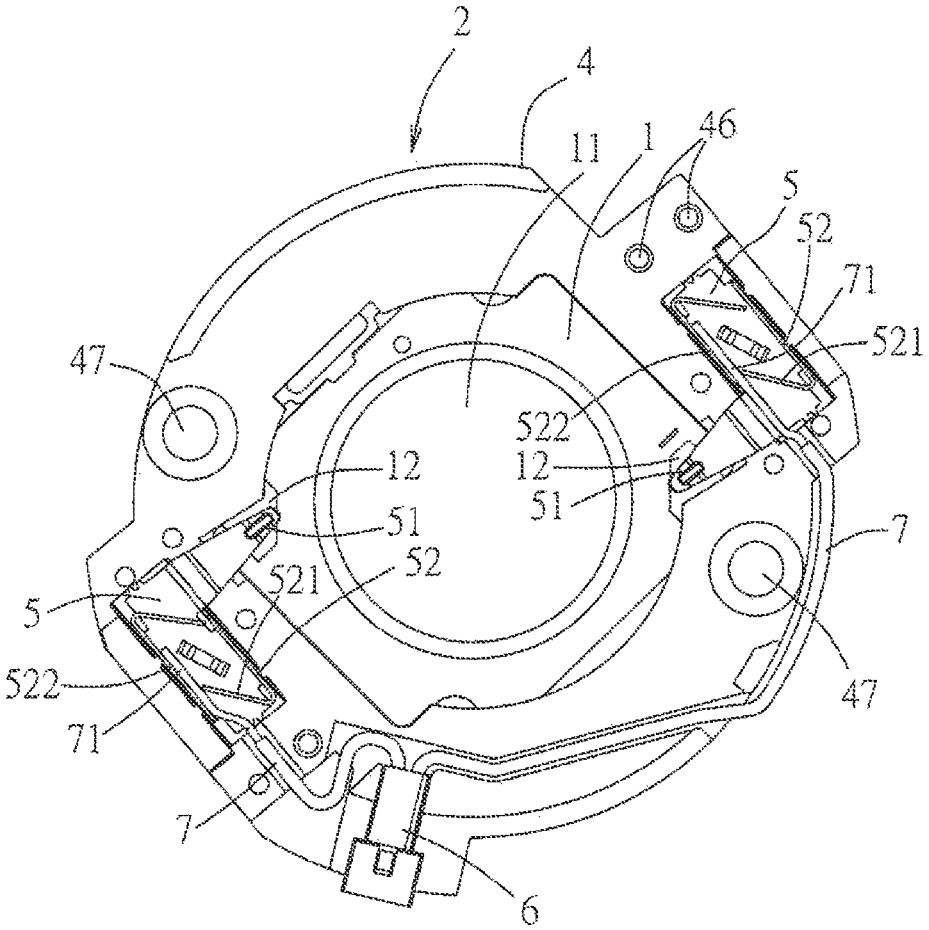
FIG. 3 is a top view illustrating the holder and an assembly relationship between the holder and a light emitting module of the first embodiment.
Figure 4:
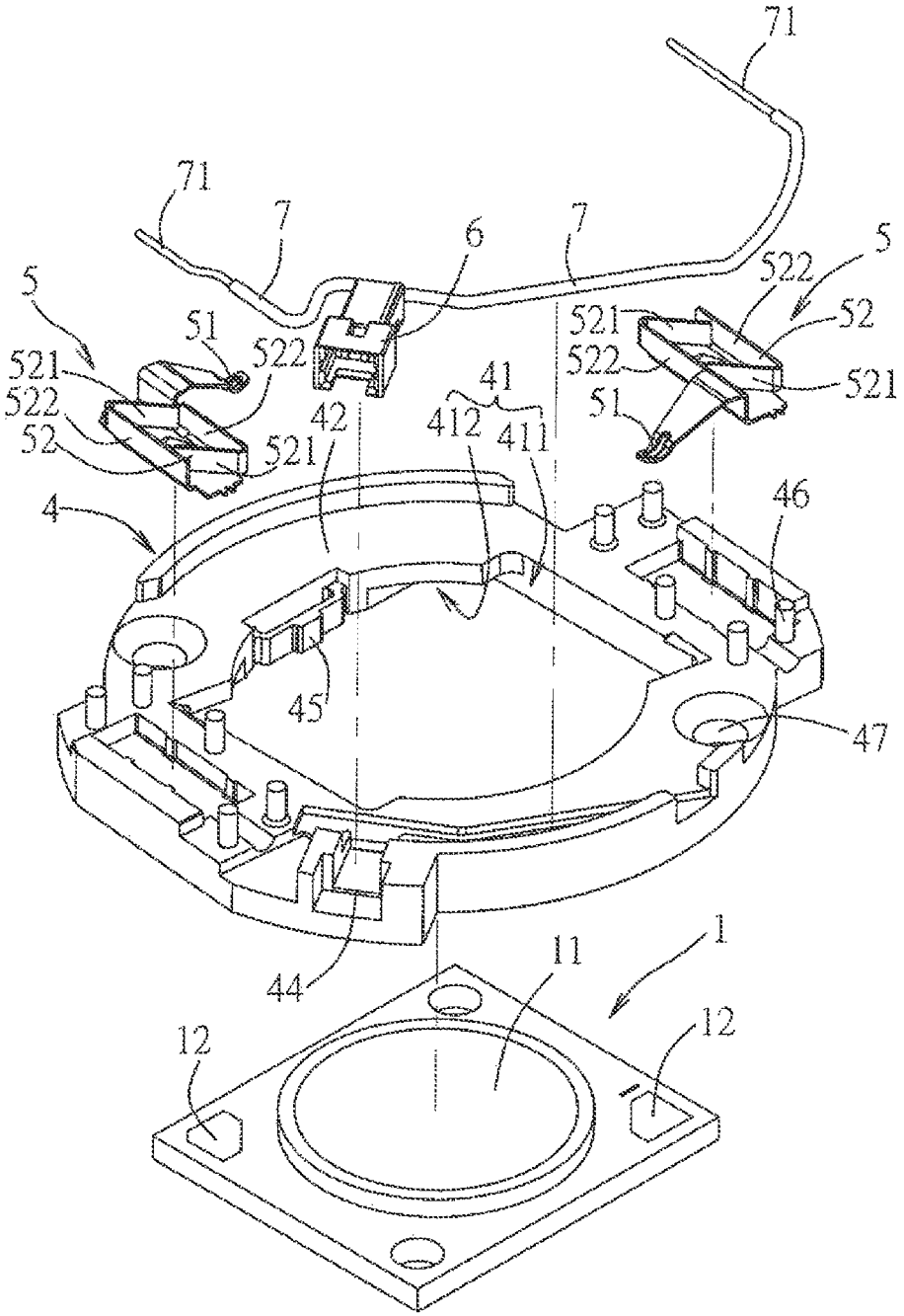
FIG. 4 is an exploded perspective view illustrating components of the holder and the light emitting module of the first embodiment.
Figure 5:
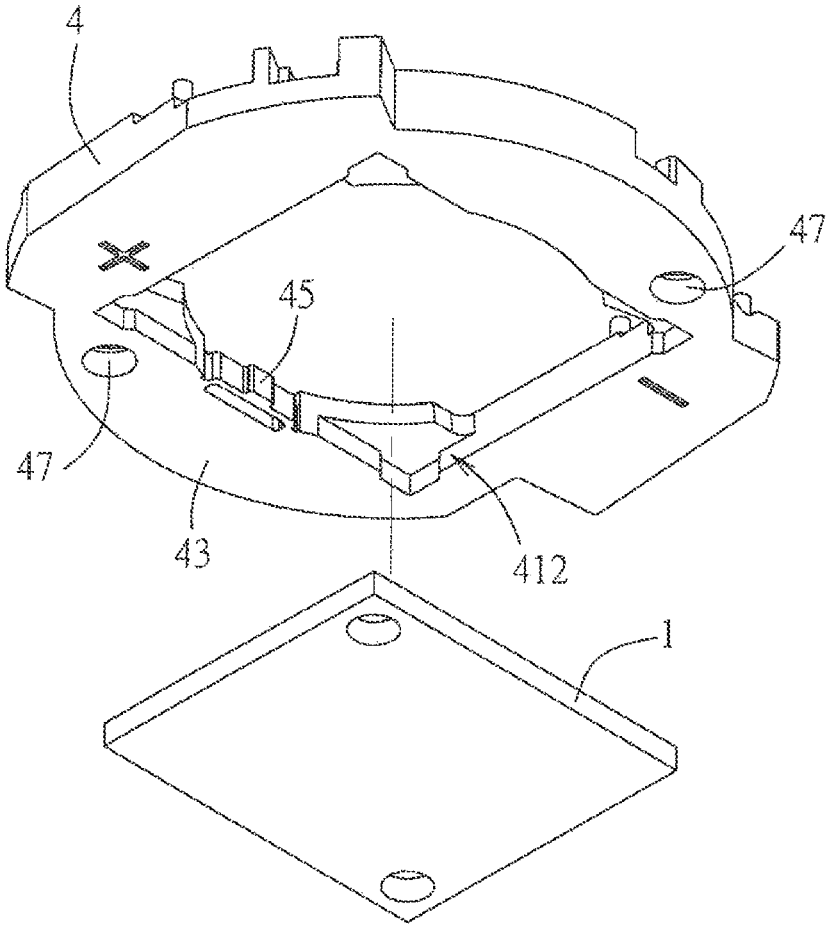
FIG. 5 is an exploded perspective view illustrating an assembly relationship between the holder and the light emitting module of the first embodiment.

Referring to FIG. 3 through FIG. 5, the light emitting module 1 has a light emitting portion 11 and two contact pads 12, the number of the contact pads 12 may be more than two, depending on the practical requirement, and it is not limited to the embodiment. The light emitting module 1 specifically may be a light emitting module packaging a plurality of light emitting diodes dies.

The holder 2 comprises a base body 4, two terminals 5, a connector 6 and two wires 7. The base body 4 defines a receiving hole 41 for receiving the light emitting module 1, and has a top face 42, a bottom face 43 and a mounting groove 44 for receiving the connector 6. The receiving hole 41 has a window portion 411 passing through the top face 42 and a frame groove portion 412 recessed from the bottom face 43 toward the top face 42, and the window portion 411 and the frame groove portion 412 are communicated. The light emitting module 1 is received in the frame groove portion 412 and the light emitting portion 11 is exposed from the window portion 411. The base body 4 further has a resilient abutting block 45 defining a part of the frame groove portion 412 to abut against a side edge of the light emitting module 1. By that the resilient abutting block 45 has contractible resilience, when the light emitting module 1 is placed into the frame groove portion 412 along a direction from down to up as shown in FIG. 5, the side edge of the light emitting module 1 may be abut against and pressed against the resilient abutting block 45 to allow the resilient abutting block 45 to contract inwardly so as to expand the frame groove portion 412, that is it is easy to place the light emitting module 1 into the frame groove portion 412, after the light emitting module 1 completely enters into the frame groove portion 412, the resilient abutting block 45 immediately abuts against and presses against the side edge of the light emitting module 1 by resilience restoring force thereof, so that the light emitting module 1 is pre-retained so as to be conveniently fixed, along with the holder 2, to a carrying platform (not shown, such as a heat sink or a circuit board and the like). In the embodiment, the resilient abutting block 45 is provided as only one in number, but in an equivalent embodiment, the resilient abutting block 45 may be also provided as multiple in number, for example, adjacent or opposite positions each allow one resilient abutting block 45 to be provided.

The terminals 5 are provided to the base body 4 and each have a pressing contact portion 51 and a wire insertion structure 52. The pressing contact portions 51 extend into the receiving hole 41 and respectively press against the contact pads 12 of the light emitting module 1, so as to establish an electrical connection with the light emitting module 1. The number of the terminals 5 substantially corresponds to the number of the contact pads 12 of the light emitting module 1, when the contact pad 12 is provided as more than two in number, the number of the terminals 5 may also be adjusted, but it is not limited to the embodiment.

The connector 6 is provided to the base body 4, that is, the connector 6 is received in the mounting groove 44, so as to externally connect the mating connector 9 (see FIG. 1).

Two wires 7 respectively correspond to the terminals 5 to allow one end of each wire 7 to be detachably connected to the wire insertion structure 52 of the corresponding terminal 5, and the other end of the each wire 7 to be connected to a terminal of the connector 6, so that the terminals 5 and the connector 6 are electrically connected. Since one end of the wire 7 is detachably connected to the wire insertion structure 52, two kinds of assembly can be provided for selection. One of the assembly is namely the assembly of the embodiment, the wire 7 is connected to mating connector 9 via the connector 6 so as to connect an external power, which is convenient to assemble; the other assembly is that the two wires 7 are detached from the wire insertion structures 52 and the connector 6 is removed together, so as to allow an external wire (not shown) to be directly inserted into the wire insertion structures 52 to meet different assembly requirements. In the embodiment, the wire insertion structures 52 of the terminals 5 are in form of wire trap and in form of two-way wire trap, so as to be convenient to select positions of wiring. Naturally, the wire insertion structures 52 of the terminals 5 may also select as in form of one-way wire trap. The wire insertion structure 52 in form of two-way wire trap has two opposite resilient clip pieces 521 and two fixed clip piece 522 respectively cooperating with the two resilient clip pieces 521; if the wire insertion structure 52 is in form of one-way wire trap, there is only one resilient clip piece 521 to cooperate with one fixed clip piece 522. When the wire 7 is mounted to allow the wire 7 to be connected with the wire insertion structure 52, an outer insulation of the wire 7 at the end portion is removed to expose a central metal conductor 71, and the central metal conductor 71 is clamped between the resilient clip piece 521 and the fixed clip piece 522 of the wire insertion structure 52, so as to allow the wire 7 and the terminal 5 to establish an electrical connection.

Again referring to FIG. 1 and FIG. 2, the cover 3 covers the holder 2, and is assembled to and engaged with the holder 2, and covers the mounting groove 44 so as to fix, together with the mounting groove 44, the connector 6; and the cover 3 has an opening 31 for exposing the light emitting portion 11 of the light emitting module 1 and an aperture 32 which allows the connector 6 to expose outwardly and allow the mating connector 9 to pass through so as to mate with the connector 6. Specifically, the base body 4 of the holder 2 is formed with a plurality of alignment protruding posts 46 on a top face 42 thereof, and the cover 3 has a plurality of alignment through holes 33 respectively corresponding to the plurality of alignment protruding posts 46, so as to easily position the cover 3 and the holder 2 with respect to each other and assembled to and engaged with each other. The base body 4 is further formed with two fixing holes 47 thereon, and the cover 3 is formed with two fixing holes 34 respectively corresponding to the two fixing holes 47, so as to allow fasteners (not shown, such as bolt and the like) to pass through and in turn fix the illumination device 100 to a carrying platform (not shown, such as a heat sink or a circuit board and the like).

Figure 6:
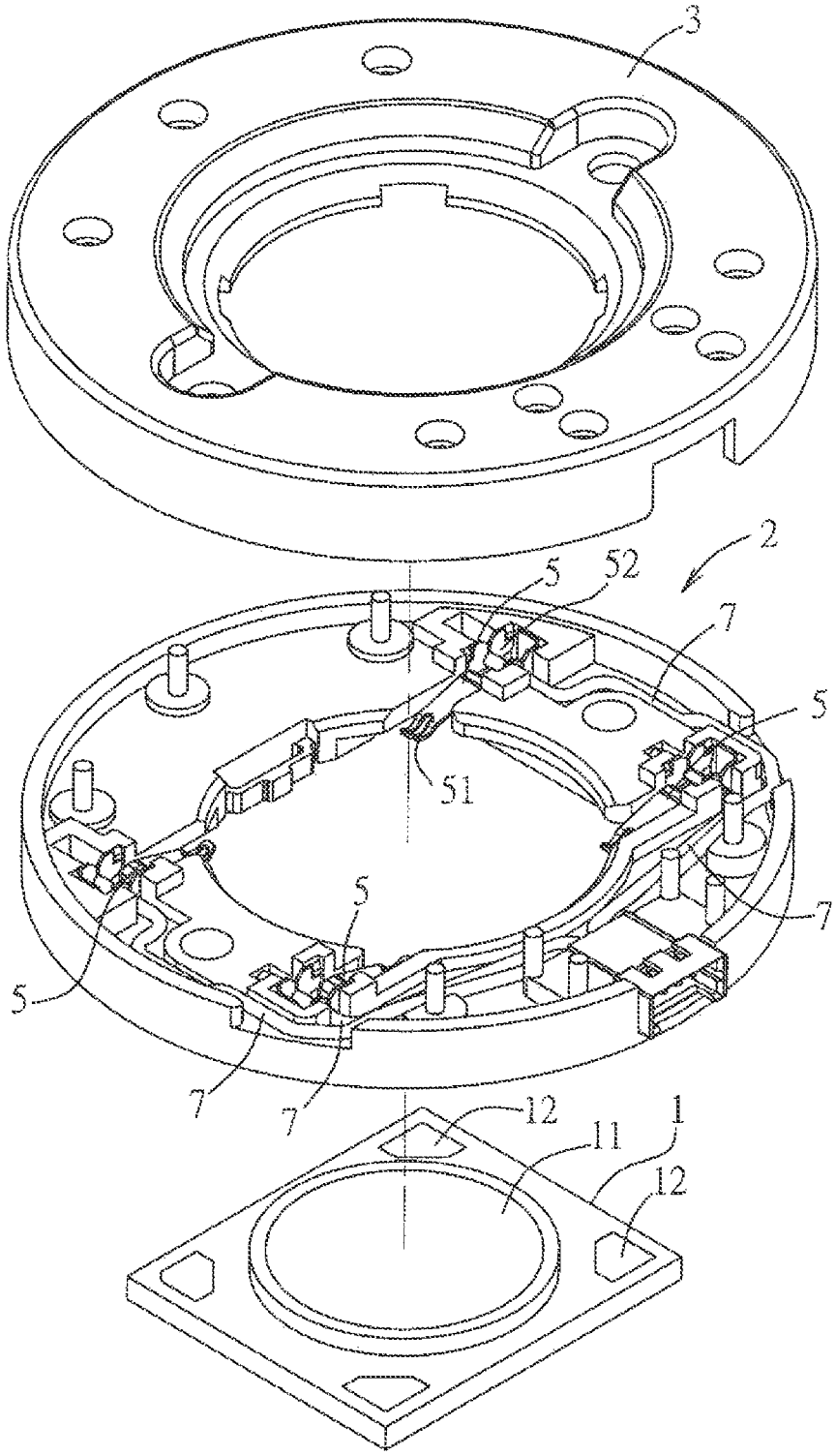
FIG. 6 is an exploded perspective view illustrating a second embodiment of the illumination device of the present disclosure.
Figure 7:
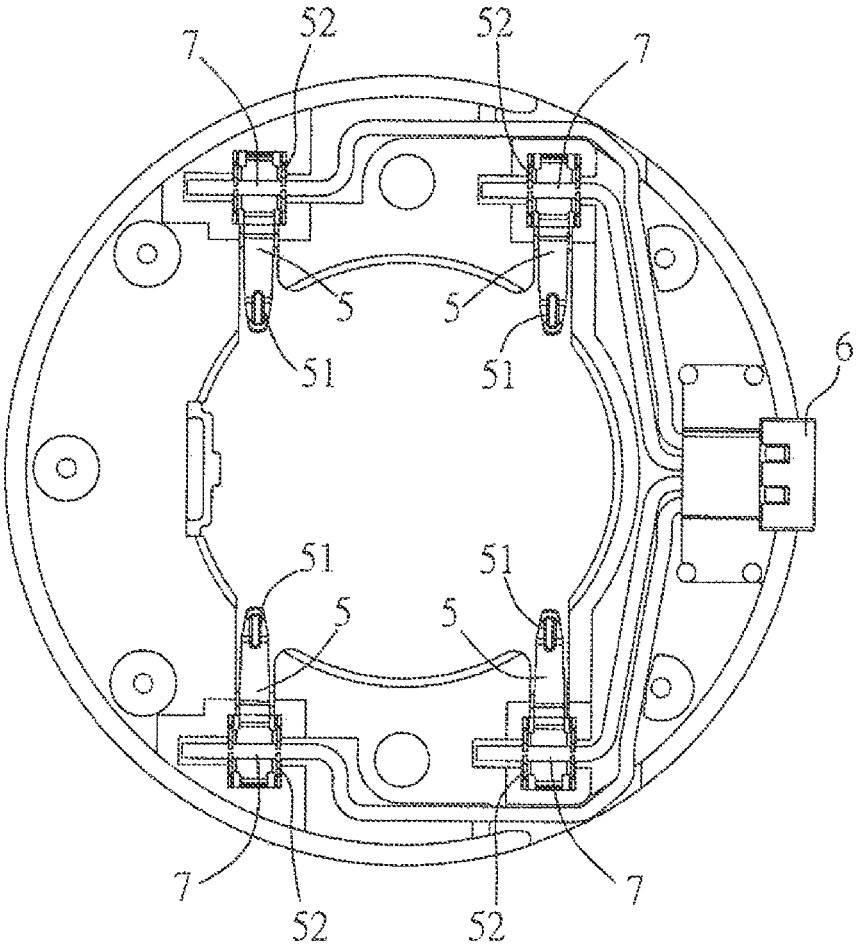
FIG. 7 is a top view illustrating a holder of the second embodiment.
Figure 8:
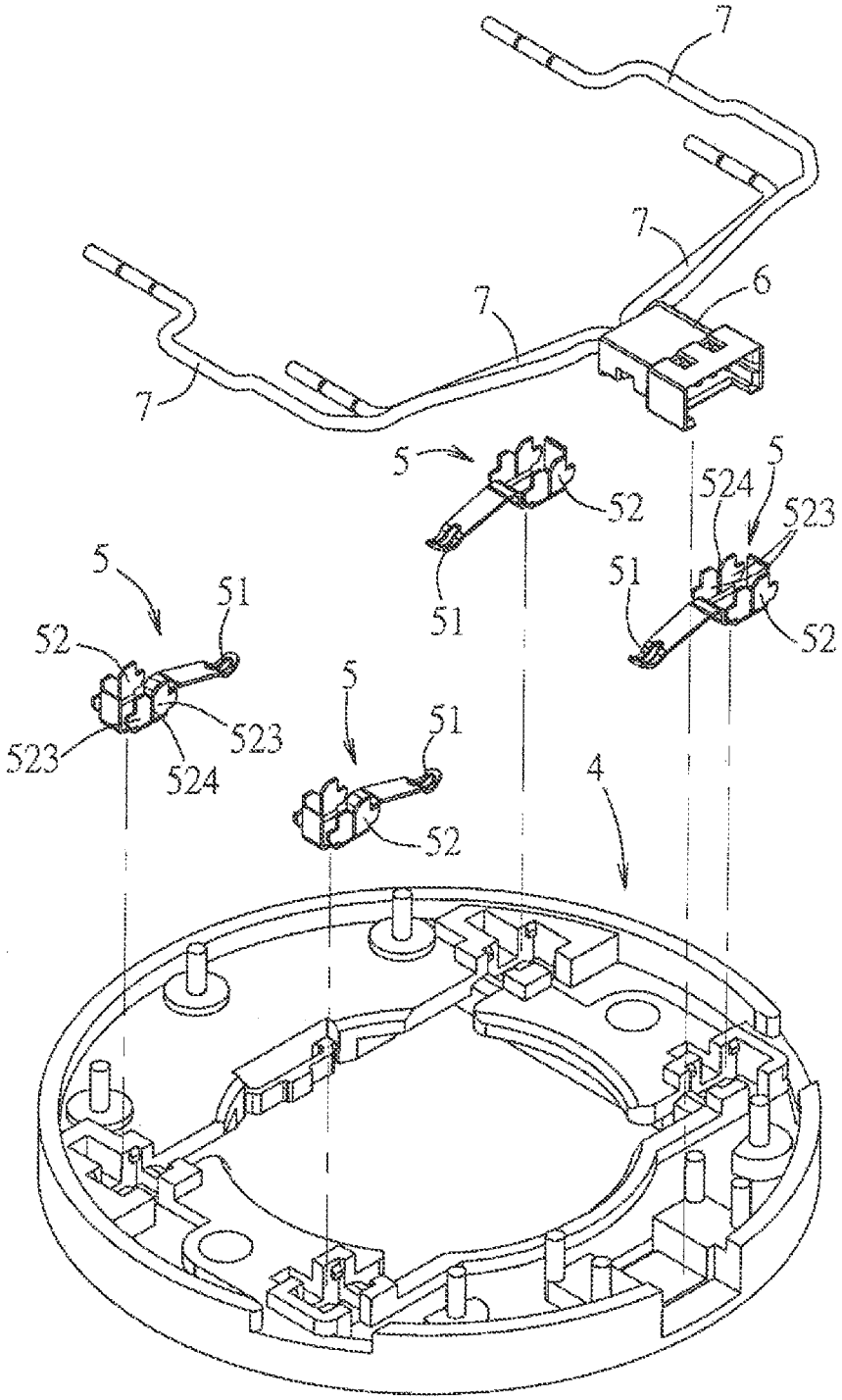
FIG. 8 is an exploded perspective view illustrating the holder of the second embodiment.

Referring to FIG. 6 through FIG. 8, a second embodiment of the illumination device 100 of the present disclosure is substantially the same as the first embodiment, however, in the second embodiment, the contact pad 12 of the light emitting module 1 is provided as four in number, the terminal 5 of the holder 2 is also correspondingly provided as four in number, and the four terminals 5 are electrically connected to the connector 6 respectively via four wires 7. Moreover, in the second embodiment, the wire insertion structure 52 of each terminal 5 is replaced as in form of insulation-displacement termination (IDT). That is, the wire insertion structure 52 has two pairs of clip pieces 523, a blade gap 524 is formed between each pair of clip pieces 523, when the wire 7 is placed into the blade gap 524, an outer insulation of the wire 7 is displaced by the clip pieces 523 at both sides of the blade gap 524, so as to allow the central metal conductor 71 (see FIG. 4) inside the wire 7 to contact the clip piece(s) 523 and establish an electrical connection, that is the wire 7 and the terminal 5 establish an electrical connection. Reversed operation may remove the wire 7 from the wire insertion structure 52.

In conclusion, the holder 2 has the connector 6 to mate with the mating connector 9 so as to allow convenient assembly, and the connector 6 and the terminal 5 are connected via the wire 7, which may omit arrangement of traces so as to simplify the manufacturing process and save the cost. Moreover, one end of the wire 7 is detachably connected to the terminal 5, when the connector 6 is not required, the wire 7 is removed together with the connector 6, so as to meet different mounting requirements, so that the holder 2 has multi-functionality. Or with the above configuration, it can provide two connecting manners for a client to select.

The above described are only the embodiments of the present disclosure, which cannot limit the scope of the implementation of the present disclosure, that is, simple equivalent variations and modifications made according to the scope of the Claims and the description content of the present disclosure are still fallen within the scope of the present disclosure.

What is claimed is:

1. A holder, comprising a base body defining a receiving hole;

at least two terminals provided to the base body, each of the terminals having a pressing contact portion extending into the receiving hole and a wire insertion structure configured to detachably connect to a wire;

a connector provided to the base body; and at least two wires supported by the base body, wherein one end of each wire of the at least two wires is respectively detachaby connected to one of the corresponding terminals and the other end of each wire of the at least two wires is connected to the connector, wherein the terminals and the connector are electrically connected.

2. The holder of claim 1, wherein the base body has a mounting groove for receiving the connector.

3. The holder of claim 1, wherein the wire insertion structure of the terminals is a wire trap.

4. The holder of claim 3, wherein the wire insertion structure of the terminals is a two-way wire trap.

5. The holder of claim 1, wherein the wire insertion structure of the terminals are in form of insulation-displacement termination.

6. The holder of claim 1, wherein the base body has a top face and a bottom face, and the receiving hole has a window portion passing through the top face and a frame groove portion recessed from the bottom face toward the top face, and the window portion and the frame groove portion are communicated;

the base body further has at least a resilient abutting block defining a part of the frame groove portion.

7. An illumination device, comprising:

a light emitting module having a light emitting portion and at least two contact pads; and a holder, comprising:

a base body defining a receiving hole for receiving the light emitting module;

at least two terminals supported by the base body, each terminal of the at least two terminals having a pressing contact portion and a wire insertion structure, the pressing contact portions extending into the receiving hole and respectively pressing against the contact pads of the light emitting module;

a connector provided to the base body, the connector configured to externally connect to a mating connector; and at least two wires supported by the base body, each wire of the at least two wires having one end respectively connected to one of the at least two terminals and wherein another end of each of the wires of the at least two wires is connected to the connector so that the terminals and the connector are electrically connected via the at least two wires.

8. The illumination device of claim 7, wherein the base body has a mounting groove for receiving the connector.

9. The illumination device of claim 8, further comprising:

a cover covering the holder and assembled to and engaged with the holder, and having an opening for exposing the light emitting portion and an aperture which allows the connector to expose outwardly.

10. The illumination device of claim 9, wherein the base body further has a top face and a bottom face, and the receiving hole has a window portion passing through the top face and a frame groove portion recessed from the bottom face toward the top face, and the window portion and the frame groove portion are communicated, the light emitting module is received in the frame groove portion and the light emitting portion is exposed from the window portion;

the base body further has at least a resilient abutting block defining a part of the frame groove portion to abut against a side edge of the light emitting module.

11. The illumination device of claim 7, wherein the wire insertion structures of the terminals are in form of wire trap.

12. The illumination device of claim 11, wherein the wire insertion structures of the terminals are in form of two-way wire trap.

13. The illumination device of claim 7, wherein the wire insertion structures of the terminals are in form of insulation-displacement termination.

* * * * *